US010100490B1

(12) United States Patent
August

(10) Patent No.: US 10,100,490 B1
(45) Date of Patent: Oct. 16, 2018

(54) MACHINE PUSHED TRENCHER ASSEMBLY

(71) Applicant: Roger August, Pagosa Springs, CO (US)

(72) Inventor: Roger August, Pagosa Springs, CO (US)

( * ) Notice: Subject to any disclaimer, the term of this patent is extended or adjusted under 35 U.S.C. 154(b) by 0 days.

(21) Appl. No.: 15/696,523

(22) Filed: Sep. 6, 2017

(51) Int. Cl.
*E01H 5/02* (2006.01)
*E02F 5/02* (2006.01)
*E02F 5/14* (2006.01)

(52) U.S. Cl.
CPC ..... *E02F 5/027* (2013.01); *E02F 5/14* (2013.01)

(58) Field of Classification Search
CPC ... E02F 5/027; E02F 5/02; E02F 5/106; E02F 3/962; E02F 3/3604; A01B 13/00; E01H 5/06; E01H 5/061
See application file for complete search history.

(56) References Cited

U.S. PATENT DOCUMENTS 270,824 A * 1/1883 Michaelis ..... A01B 49/022 172/63
591,432 A * 10/1897 Smith et al. ..... E01H 5/066 37/270
970,818 A * 9/1910 Harryman ..... E02F 5/102 37/370
1,002,344 A * 9/1911 Watson ..... A01C 23/025 111/123
1,230,622 A * 6/1917 Tallyn ..... E01H 5/066 37/270
1,853,940 A * 4/1932 Soule ..... E01H 5/065 37/272
1,871,565 A * 8/1932 Soule ..... E01H 5/061 37/272
1,987,268 A * 1/1935 Roby ..... E02F 5/027 111/152
1,994,817 A * 3/1935 Gustafson ..... E02F 3/7618 172/785
2,231,268 A * 2/1941 Hoare ..... E01H 5/06 37/272
2,261,874 A * 11/1941 Cundiff ..... E02F 5/027 37/372
2,431,410 A * 11/1947 Maxim ..... E01H 5/06 37/231
2,662,614 A * 12/1953 Briscoe ..... E02F 5/027 188/7

(Continued)

FOREIGN PATENT DOCUMENTS

GB 2278622 A * 12/1994 ..... E01C 19/2005
WO WO2014161984 10/2014

*Primary Examiner* — Jamie L McGowan

(57) ABSTRACT

A machine pushed trencher assembly includes a first plate that is triangularly shaped. A pair of second plates is coupled singly to and extends transversely from opposing sides of the first plate. The second plates are coupled to define a cutting edge. A fourth plate that is coupled to a base of the first plate is configured to couple to a front end of a machine. A second bar is coupled to the fourth plate and extends angularly above the second plates. A third bar is pivotally coupled to the second bar. An actuator is coupled to the second and third bars. At least one wheel is rotationally coupled to the third bar. The machine compels the cutting edge through a substrate to prepare a trench. The actuator positions the wheel so that it rolls on a surface of the substrate to control a depth of the trench.

15 Claims, 5 Drawing Sheets

(56) References Cited

U.S. PATENT DOCUMENTS 2,668,376 A * 2/1954 Briscoe ..... A01B 13/00 37/366
2,673,408 A * 3/1954 Meyer ..... A01B 11/00 37/372
2,698,491 A * 1/1955 Felt ..... E02F 3/841 172/316
2,712,187 A * 7/1955 Winter ..... E02F 5/027 172/460
2,990,632 A * 7/1961 Noblin ..... A01B 13/00 172/149
3,068,595 A * 12/1962 Winn ..... A01B 13/00 172/159
3,483,642 A * 12/1969 Glesmann ..... E01H 5/06 172/794
3,601,910 A * 8/1971 Goltz ..... E02F 3/7686 280/43.23
4,098,344 A * 7/1978 Johnson ..... E02D 3/026 172/170
4,127,951 A * 12/1978 Hatch ..... E01H 5/06 172/272
4,240,216 A * 12/1980 Martel ..... A01B 13/00 172/398
4,243,356 A * 1/1981 Takojima ..... E02F 3/3622 37/403
4,255,884 A * 3/1981 Williams ..... E02F 3/962 37/231
4,428,132 A * 1/1984 Reece ..... E02F 5/106 37/370
4,509,768 A * 4/1985 Haug ..... A01B 59/062 172/272
4,625,988 A * 12/1986 Witchey ..... E02F 3/364 172/273
4,833,797 A 5/1989 Slunecka et al.
4,892,155 A * 1/1990 Wanamaker ..... E02F 3/3414 172/199
5,092,409 A * 3/1992 Defrancq ..... A01B 63/108 172/239
5,199,196 A * 4/1993 Staley ..... E01C 21/00 111/118
5,212,897 A * 5/1993 Jefferson ..... E02F 3/962 37/379
5,273,375 A * 12/1993 Plourde ..... E01C 19/15 37/403
5,291,954 A * 3/1994 Kirwan ..... A01B 73/065 172/273
5,529,131 A * 6/1996 Van Ornum ..... E02F 3/80 172/776
5,615,499 A * 4/1997 McGuire ..... E02D 17/06 37/367
5,730,229 A * 3/1998 Nilsson ..... E02F 3/7677 172/832
5,943,798 A * 8/1999 McGuire ..... E02D 17/06 37/367
6,318,006 B1 * 11/2001 Hall ..... E02F 3/3414 172/681
6,351,900 B1 3/2002 DeWind
6,516,545 B2 * 2/2003 Jenkins, Jr. ..... E02F 3/08 37/362
6,527,063 B2 3/2003 Rust et al.
6,578,295 B1 * 6/2003 McPherson ..... A01B 59/048 172/273
6,814,322 B1 * 11/2004 Slaby ..... A01F 25/2027 172/272
D579,464 S 10/2008 Sewell et al.
7,454,850 B2 * 11/2008 Smith ..... A01B 33/02 172/817
7,654,017 B2 * 2/2010 Black ..... E02F 3/12 37/352
7,654,551 B2 * 2/2010 Page ..... E02F 9/02 280/416.1
7,758,285 B2 * 7/2010 O'Dell ..... E02F 5/027 172/720
8,083,005 B1 * 12/2011 Nicolai ..... E02F 3/7631 172/393
8,157,477 B2 * 4/2012 Horan ..... E02F 3/3414 37/190
8,522,461 B2 9/2013 Kirian
9,051,713 B1 6/2015 Thompson
2007/0180742 A1 * 8/2007 Kallevig ..... E02F 3/3609 37/403
2010/0319225 A1 * 12/2010 Namon, II ..... E02F 3/404 37/468
2014/0283422 A1 * 9/2014 Cloutier ..... E02F 3/3618 37/403

* cited by examiner

MACHINE PUSHED TRENCHER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to trencher assemblies and more particularly pertains to a new trencher assembly for preparing a trench.

BRIEF SUMMARY OF THE INVENTION

An embodiment of the disclosure meets the needs presented above by generally comprising a first plate that is triangularly shaped. A pair of second plates is coupled singly to and extends transversely from opposing sides of the first plate. The second plates are coupled to define a cutting edge. A fourth plate that is coupled to a base of the first plate is configured to couple to a front end of a machine. A second bar is coupled to the fourth plate and extends angularly above the second plates. A third bar is pivotally coupled to the second bar. An actuator is coupled to the second and third bars. At least one wheel is rotationally coupled to the third bar. The machine compels the cutting edge through a substrate to prepare a trench. The actuator positions the wheel so that it rolls on a surface of the substrate to control a depth of the trench.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
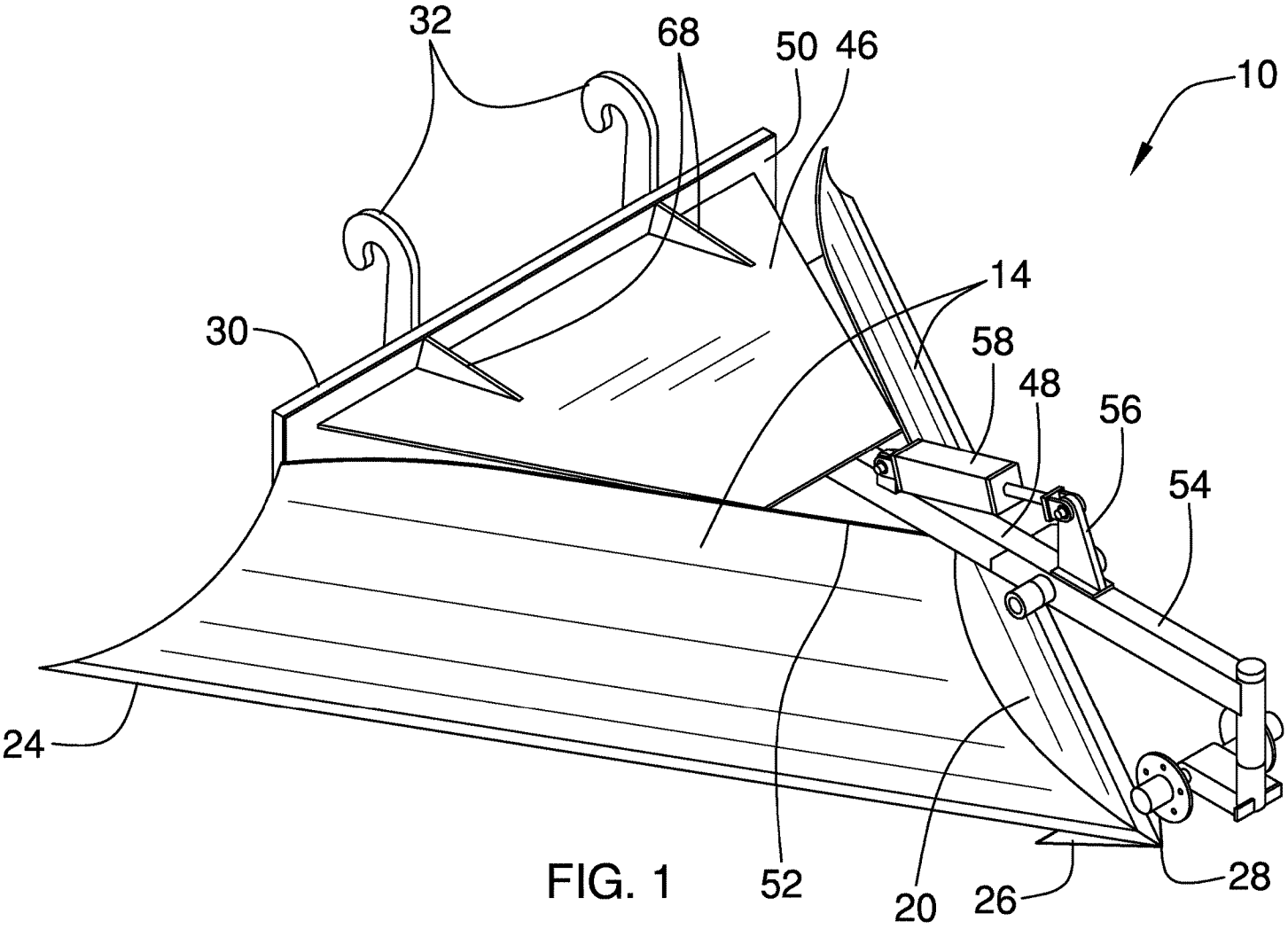
FIG. 1 is an isometric perspective view of a machine pushed trencher assembly according to an embodiment of the disclosure.
Figure 2:
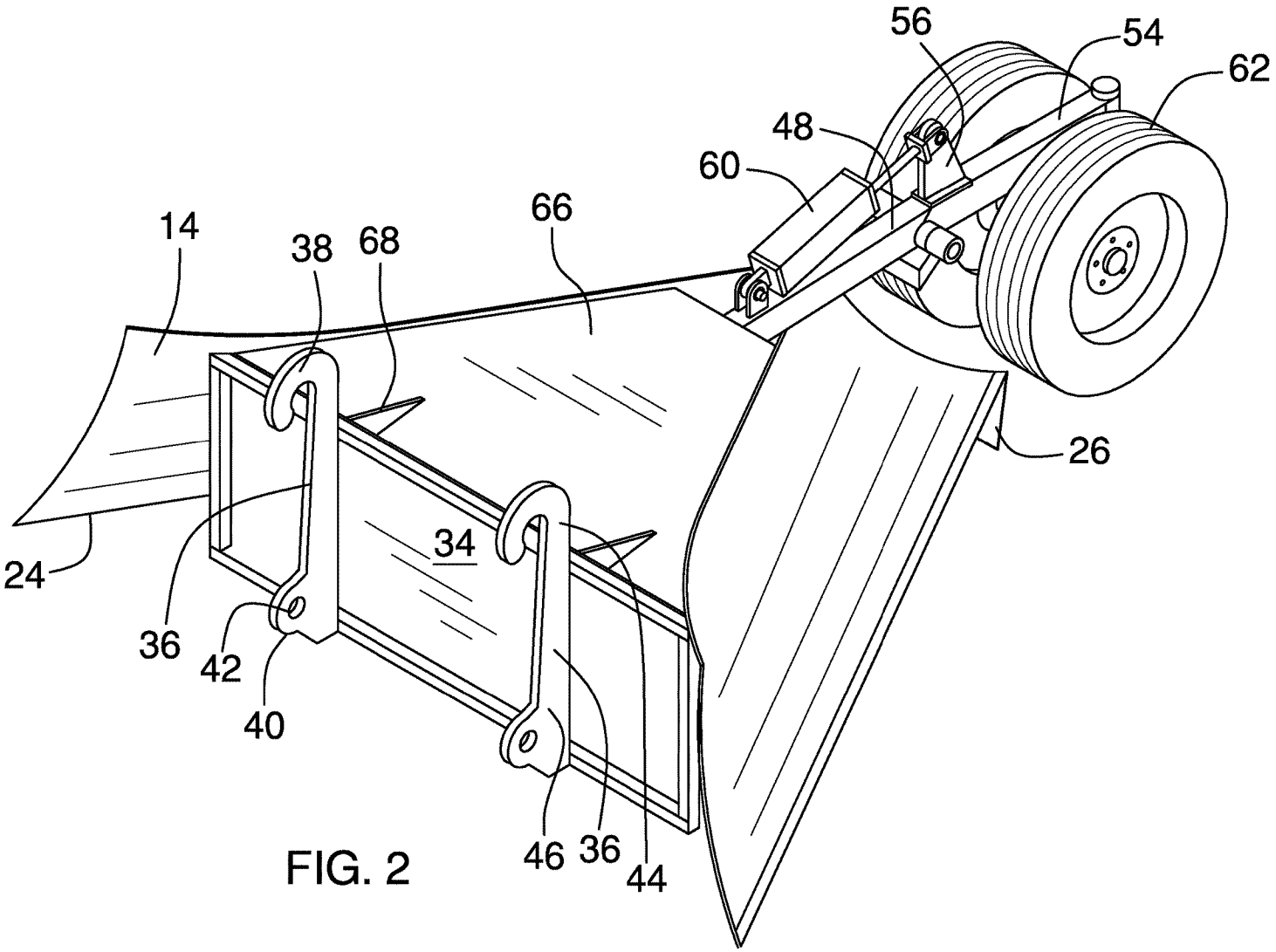
FIG. 2 is an isometric perspective view of an embodiment of the disclosure.
Figure 3:
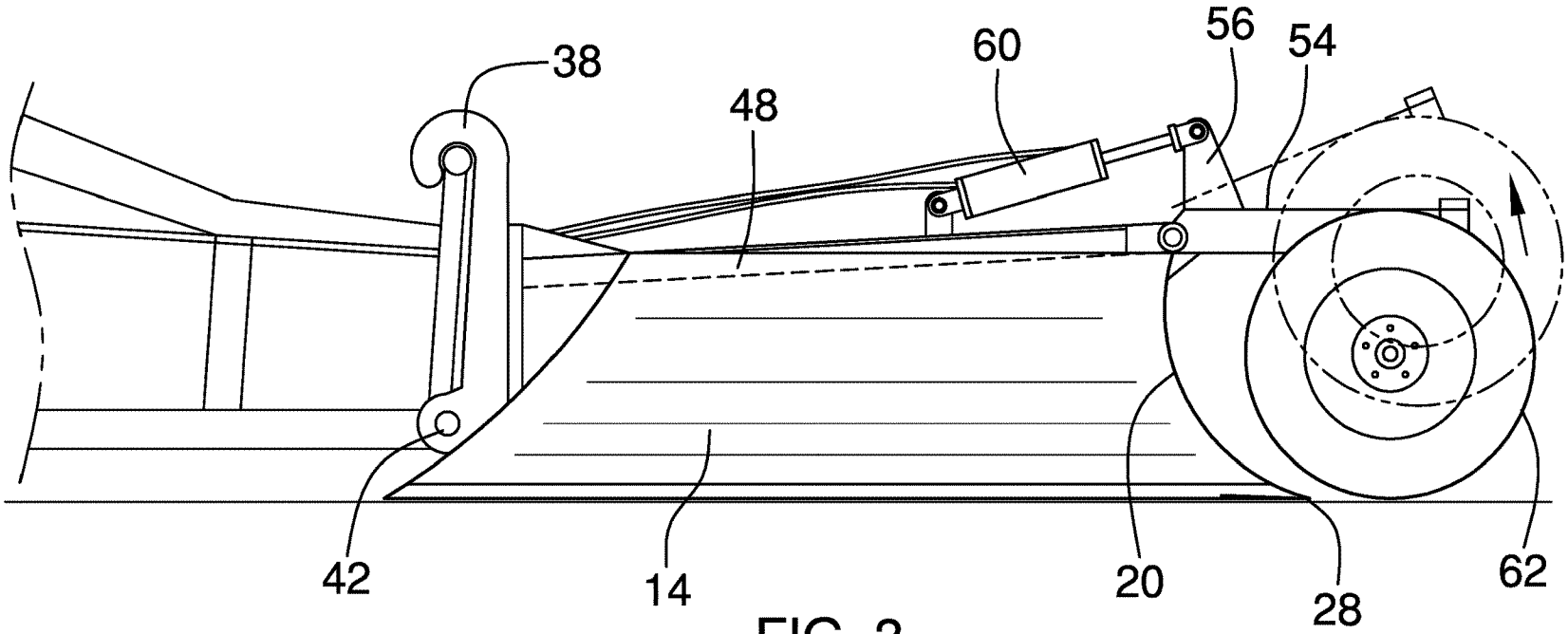
FIG. 3 is an in-use view of an embodiment of the disclosure.
Figure 4:
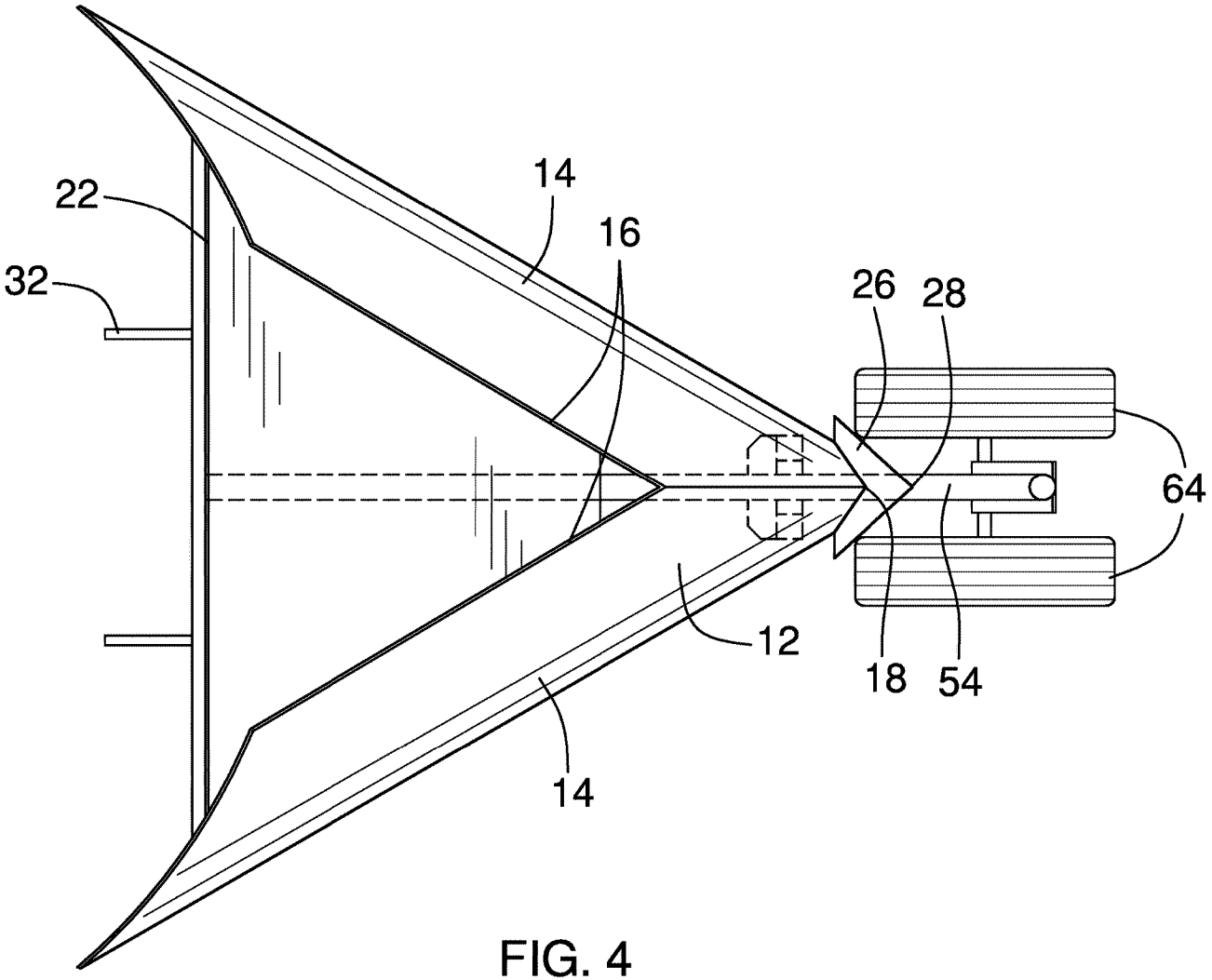
FIG. 4 is a bottom view of an embodiment of the disclosure.
Figure 5:
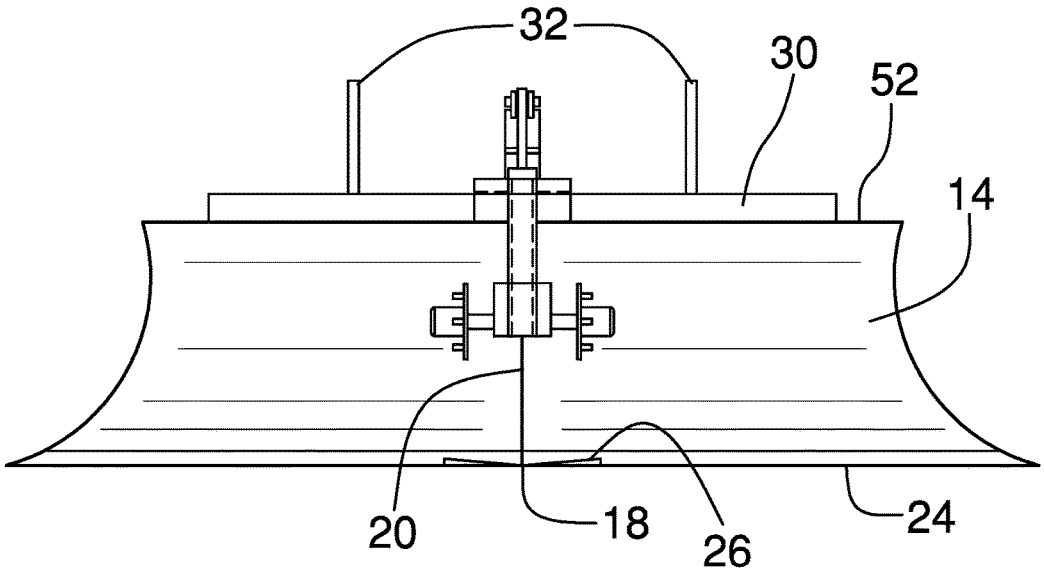
FIG. 5 is a front view of an embodiment of the disclosure.
Figure 6:
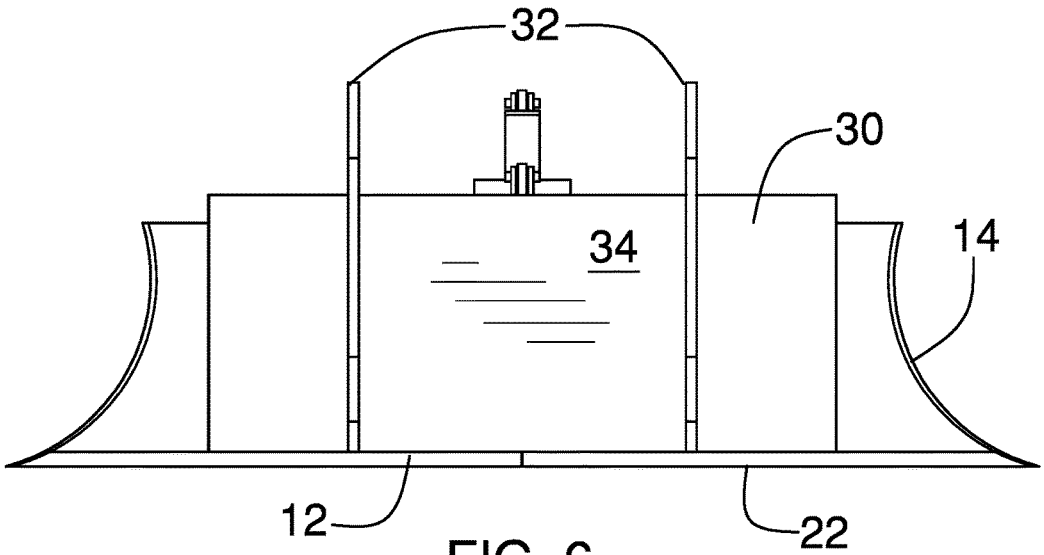
FIG. 6 is a rear view of an embodiment of the disclosure.

With reference now to the drawings, and in particular to FIGS. 1 through 6 thereof, a new trencher assembly embodying the principles and concepts of an embodiment of the disclosure and generally designated by the reference numeral 10 will be described.

As best illustrated in FIGS. 1 through 6, the machine pushed trencher assembly 10 generally comprises a first plate 12 that is triangularly shaped. Each of a pair of second plates 14 is coupled to and extends transversely from a respective opposing side 16 of the first plate 12. The second plates 14 are coupled proximate to an apex 18 of the first plate 12 to define a cutting edge 20. In one embodiment, the cutting edge 20 is arcuate. In another embodiment, the second plates 14 are arcuate proximate to a base 22 of the first plate 12. The second plates 14 are configured to direct material distally from the second plates 14. In yet another embodiment, the second plate 14 is tapered proximate to the base 22 of the first plate 12 such that a lower edge 24 of each second plate 14 extends past the base 22.

A third plate 26 is coupled to the first plate 12 adjacent to the apex 18. The third plate 26 extends coplanarly from the first plate 12 past the opposing sides 16 of the first plate 12 and defines a cutting point 28.

A fourth plate 30 is coupled to and extends substantially perpendicularly from the base 22 of the first plate 12. The fourth plate 30 is configured to couple to a front end of a machine, such as a skid loader, articulated loader, and a tracked bulldozer. The machine is configured to compel the cutting edge 20 through a substrate to prepare a trench.

A plurality of couplers 32 is coupled to an outer face 34 of the fourth plate 30. The couplers 32 are configured to couple to the front end of the machine to couple the fourth plate 30 to the machine. In one embodiment, the plurality of couplers 32 comprises two couplers 32.

In another embodiment, each coupler 32 comprises a first bar 36, a hook 38, an extrusion 40, and a penetration 42. The first bar 36 is coupled vertically to the outer face 34 of the fourth plate 30. The hook 38 is coupled to and extends from an upper end 44 of the first bar 36. The extrusion 40 is coupled to and extends from a lower end 46 of the first bar 36. The penetration 42 is positioned through the extrusion 40. The hook 38 is configured to insert a rod of the machine to couple the fourth plate 30 to the machine. The penetration 42 is configured to insert a connector to couple the extrusion 40 to the machine and to fixedly position the hook 38 on the rod of the machine.

A second bar 48 is coupled an inner face 50 of the fourth plate 30. The second bar 48 extends angularly above the second plates 14 to proximate to the apex 18 of the first plate 12. In one embodiment, the second bar 48 is rectangularly shaped when viewed longitudinally. In another embodiment, the second bar 48 is coupled to upper edges 52 of the second plates 14 proximate to the cutting edge 20.

A third bar 54 pivotally is coupled to the second bar 48 distal from the fourth plate 30. In one embodiment, the third bar 54 is rectangularly shaped when viewed longitudinally. An extension 56 is coupled to and extends from the third bar 54 proximate to the second bar 48.

An actuator 58 is coupled to the second bar 48 and the third bar 54. The actuator 58 is configured to operationally couple to the machine. In one embodiment, the actuator 58 comprises a hydraulic cylinder 60 that is pivotally coupled to and extends between the second bar 48 and the extension 56.

At least one wheel 62 is rotationally coupled to the third bar 54 distal from the second bar 48. The actuator 58 is positioned to selectively position the at least one wheel 62 relative to the apex 18. The at least one wheel 62 is configured to roll on a surface of the substrate to control a depth of the trench. In one embodiment, the at least one wheel 62 comprises a pair of rollers 64.

A fifth plate 66 is coupled to and extends from the inner face 50 of the fourth plate 30. The fifth plate 66 extends to the second bar 48. The fifth plate 66 is coupled to the second plates 14. The fifth plate 66 is positioned to brace the second plates 14 as the second plates 14 contact the substrate.

Each of a pair of sixth plates 68 is coupled to and extends between the fourth plate 30 and the fifth plate 66. The sixth plates 68 are triangularly shaped.

In use, the hook 38 is configured to insert the rod of the machine to couple the fourth plate 30 to the machine. The penetration 42 that is positioned in the extrusion 40 is configured to insert the connector to couple the extrusion 40 to the machine and to fixedly position the hook 38 on the rod of the machine. The machine is configured to compel the cutting edge 20 through the substrate to prepare the trench. The hydraulic cylinder 60 is positioned to selectively position the pair of rollers 64 relative to the apex 18. The pair of rollers 64 is configured to roll on the surface of the substrate to control the depth of the trench.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A machine pushed trencher assembly comprising:

a first plate, said first plate being triangularly shaped;

a pair of second plates, each said second plate being coupled to and extending transversely from a respective opposing side of said first plate, said second plates being coupled proximate to an apex of said first plate defining a cutting edge;

a fourth plate coupled to and extending substantially perpendicularly from a base of said first plate, said fourth plate being configured for coupling to a front end of a machine, such as a skid loader, articulated loader, and a tracked bulldozer;

a second bar coupled to an inner face of said fourth plate, said second bar extending angularly above said second plates to proximate to said apex of said first plate;

a third bar pivotally coupled to said second bar distal from said fourth plate;

an actuator coupled to said second bar and said third bar, said actuator being configured for operationally coupling to the machine;

at least one wheel rotationally coupled to said third bar distal from said second bar; and wherein said fourth plate is positioned on said first plate such that said fourth plate is configured for coupling to the machine such that the machine is configured for compelling said cutting edge through a substrate for preparing a trench, wherein said actuator is positioned on said second bar and said third bar such that said actuator is positioned for selectively positioning said at least one wheel relative to said apex such that said at least one wheel is configured for rolling on a surface of the substrate for controlling a depth of the trench.

2. The assembly of claim 1, further including said cutting edge being arcuate.

3. The assembly of claim 1, further including said second plates being arcuate proximate to said base of said first plate such that said second plates are configured for directing material distally from said second plates.

4. The assembly of claim 1, further including said second plate being tapered proximate to said base of said first plate such that a lower edge of each said second plate extends past said base.

5. The assembly of claim 1, further including a third plate coupled to said first plate adjacent to said apex, said third plate extending coplanarly from said first plate past said opposing sides of said first plate defining a cutting point.

6. The assembly of claim 1, further including a plurality of couplers coupled to an outer face of said fourth plate, said couplers being configured for coupling to the front end of the machine, wherein said couplers are positioned on said fourth plate such that said couplers are configured for coupling said fourth plate to the machine.

7. The assembly of claim 6, further including said plurality of couplers comprising two said couplers.

8. The assembly of claim 6, further including each said coupler comprising a first bar, a hook, an extrusion, and a penetration, said first bar being coupled vertically to said outer face of said fourth plate, said hook being coupled to and extending from an upper end of said first bar, said extrusion being coupled to and extending from a lower end of said first bar, said penetration being positioned through said extrusion, wherein said hook is positioned on said first bar such that said hook is configured for inserting a rod of the machine for coupling said fourth plate to the machine, wherein said extrusion is positioned on said first bar such that said penetration is configured for inserting a connector for coupling said extrusion to the machine and fixedly positioning said hook on the rod of the machine.

9. The assembly of claim 1, further including said second bar and said third bar being rectangularly shaped when viewed longitudinally.

10. The assembly of claim 1, further including said second bar being coupled to upper edges of said second plates proximate to said cutting edge.

11. The assembly of claim 1, further comprising:

an extension coupled to and extending from said third bar proximate to said second bar; and said actuator comprising a hydraulic cylinder pivotally coupled to and extending between said second bar and said extension.

12. The assembly of claim 1, further including said at least one wheel comprising a pair of rollers.

13. The assembly of claim 1, further including a fifth plate coupled to and extending from said inner face of said fourth plate, said fifth plate extending to said second bar, said fifth plate being coupled to said second plates, wherein said fifth plate is positioned on said fourth plate and said second plates such that said fifth plate is positioned for bracing said second plates as said second plates contact the substrate.

14. The assembly of claim 13, further including a pair of sixth plates coupled to and extending between said fourth plate and said fifth plate, said sixth plates being triangularly shaped.

15. A machine pushed trencher assembly comprising:

a first plate, said first plate being triangularly shaped;

a pair of second plates, each said second plate being coupled to and extending transversely from a respective opposing side of said first plate, said second plates being coupled proximate to an apex of said first plate defining a cutting edge, said cutting edge being arcuate, said second plates being arcuate proximate to a base of said first plate such that said second plates are configured for directing material distally from said second plates, said second plate being tapered proximate to said base of said first plate such that a lower edge of each said second plate extends past said base;

a third plate coupled to said first plate adjacent to said apex, said third plate extending coplanarly from said first plate past said opposing sides of said first plate defining a cutting point;

a fourth plate coupled to and extending substantially perpendicularly from said base of said first plate, said fourth plate being configured for coupling to a front end of a machine, such as a skid loader, articulated loader, and a tracked bulldozer, wherein said fourth plate is positioned on said first plate such that said fourth plate is configured for coupling to the machine such that the machine is configured for compelling said cutting edge through a substrate for preparing a trench;

a plurality of couplers coupled to an outer face of said fourth plate, said couplers being configured for coupling to the front end of the machine, wherein said couplers are positioned on said fourth plate such that said couplers are configured for coupling said fourth plate to the machine, said plurality of couplers comprising two said couplers, each said coupler comprising a first bar, a hook, an extrusion, and a penetration, said first bar being coupled vertically to said outer face of said fourth plate, said hook being coupled to and extending from an upper end of said first bar, said extrusion being coupled to and extending from a lower end of said first bar, said penetration being positioned through said extrusion, wherein said hook is positioned on said first bar such that said hook is configured for inserting a rod of the machine for coupling said fourth plate to the machine, wherein said extrusion is positioned on said first bar such that said penetration is configured for inserting a connector for coupling said extrusion to the machine and fixedly positioning said hook on the rod of the machine;

a second bar coupled an inner face of said fourth plate, said second bar extending angularly above said second plates to proximate to said apex of said first plate, said second bar being rectangularly shaped when viewed longitudinally, said second bar being coupled to upper edges of said second plates proximate to said cutting edge;

a third bar pivotally coupled to said second bar distal from said fourth plate, said third bar being rectangularly shaped when viewed longitudinally;

an extension coupled to and extending from said third bar proximate to said second bar;

an actuator coupled to said second bar and said third bar, said actuator being configured for operationally coupling to the machine, said actuator comprising a hydraulic cylinder pivotally coupled to and extending between said second bar and said extension;

at least one wheel rotationally coupled to said third bar distal from said second bar, wherein said actuator is positioned on said second bar and said third bar such that said actuator is positioned for selectively positioning said at least one wheel relative to said apex such that said at least one wheel is configured for rolling on a surface of the substrate for controlling a depth of the trench, said at least one wheel comprising a pair of rollers;

a fifth plate coupled to and extending from said inner face of said fourth plate, said fifth plate extending to said second bar, said fifth plate being coupled to said second plates, wherein said fifth plate is positioned on said fourth plate and said second plates such that said fifth plate is positioned for bracing said second plates as said second plates contact the substrate;

a pair of sixth plates coupled to and extending between said fourth plate and said fifth plate, said sixth plates being triangularly shaped; and wherein said hook is positioned on said first bar such that said hook is configured for inserting the rod of the machine for coupling said fourth plate to the machine, wherein said extrusion is positioned on said first bar such that said penetration is configured for inserting the connector for coupling said extrusion to the machine and fixedly positioning said hook on the rod of the machine such that the machine is configured for compelling said cutting edge through the substrate for preparing the trench, wherein said hydraulic cylinder is positioned on said second bar and said extension such that said hydraulic cylinder is positioned for selectively positioning said pair of rollers relative to said apex such that said pair of rollers is configured for rolling on the surface of the substrate for controlling the depth of the trench.

* * * * *